US006260986B1

(12) United States Patent
Helbig et al.

(10) Patent No.: US 6,260,986 B1
(45) Date of Patent: Jul. 17, 2001

(54) ELECTRIC LAMP

(75) Inventors: Peter Helbig, Sontheim; Fritz Eckhardt, Herbrechtingen, both of (DE)

(73) Assignee: Patent-Treuhand-Gesellschaft fuer elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/447,879

(22) Filed: Nov. 23, 1999

(30) Foreign Application Priority Data

Dec. 1, 1998 (DE) ..... 198 55 411

(51) Int. Cl.[7] ..... H01R 33/00

(52) U.S. Cl. ..... 362/226; 362/438; 362/519; 362/548

(58) Field of Search ..... 362/519, 548, 362/438, 226

(56) References Cited

U.S. PATENT DOCUMENTS 1,957,821 5/1934 Drake .
4,032,739 * 6/1977 Nicolaisen et al. ..... 200/283
4,733,030 * 3/1988 Erdelitsch ..... 200/61.54
5,651,603 * 7/1997 Doring ..... 362/61
5,795,056 * 8/1998 Seiger ..... 362/263
6,095,866 * 8/2000 Helbig et al. ..... 439/619

* cited by examiner

*Primary Examiner*—Sandra O'Shea
*Assistant Examiner*—Guiyoung Lee
(74) *Attorney, Agent, or Firm*—William E. Meyer

(57) ABSTRACT

The invention relates to an electric lamp, provided with a metal-plastic cap, for a motor vehicle headlight, which has a pressing-on spring (100) which is arranged laterally on the lamp cap and serves to mount the lamp in the reflector opening, constructed as lamp holder, of the headlight. The lamp cap has a metal holder part for the lamp bulb, a metal annular carrier sleeve (14*b*) connected thereto, and a plastic cap part (15) in which the carrier sleeve (14*b*) is anchored. According to the invention, the annular carrier sleeve (14*b*) has two inwardly angled lugs (14*d*) between which the pressing-on spring (100) is arranged with a clamping fit, and which are crossed with the ends (104*a*) of the pressing-on spring (100).

7 Claims, 4 Drawing Sheets

ELECTRIC LAMP

TECHNICAL FIELD

The invention relates to electric lamps and particularly to automobile lamps. More particularly the invention is concerned with the coupling structure of an automobile lamp.

BACKGROUND ART

Such an electric lamp is disclosed, for example, in the International Patent Application WO 98/27567. This patent application describes an electric lamp, in particular a motor vehicle headlight lamp, having a vitreous lamp bulb, an incandescent filament arranged therein and a lamp cap consisting of metal and plastic parts. The lamp cap has a metal holder part for the lamp bulb, an annular metal carrier sleeve connected thereto, and plastic cap part, which is provided with the electric connections of the lamp and in which the carrier sleeve is anchored. For the purpose of fastening the lamp in the headlight reflector, the lamp cap is equipped with a pressing-on spring constructed as a cambered leaf spring. The leaf spring ends bear against the inner wall of the annular carrier sleeve, while a V-shaped section of the leaf spring reaches through a cut-out in the carrier sleeve. The leaf spring is fastened in the plastic cap part.

DISCLOSURE OF THE INVENTION

BEST MODE FOR CARRYING OUT THE INVENTION

Figure 1:
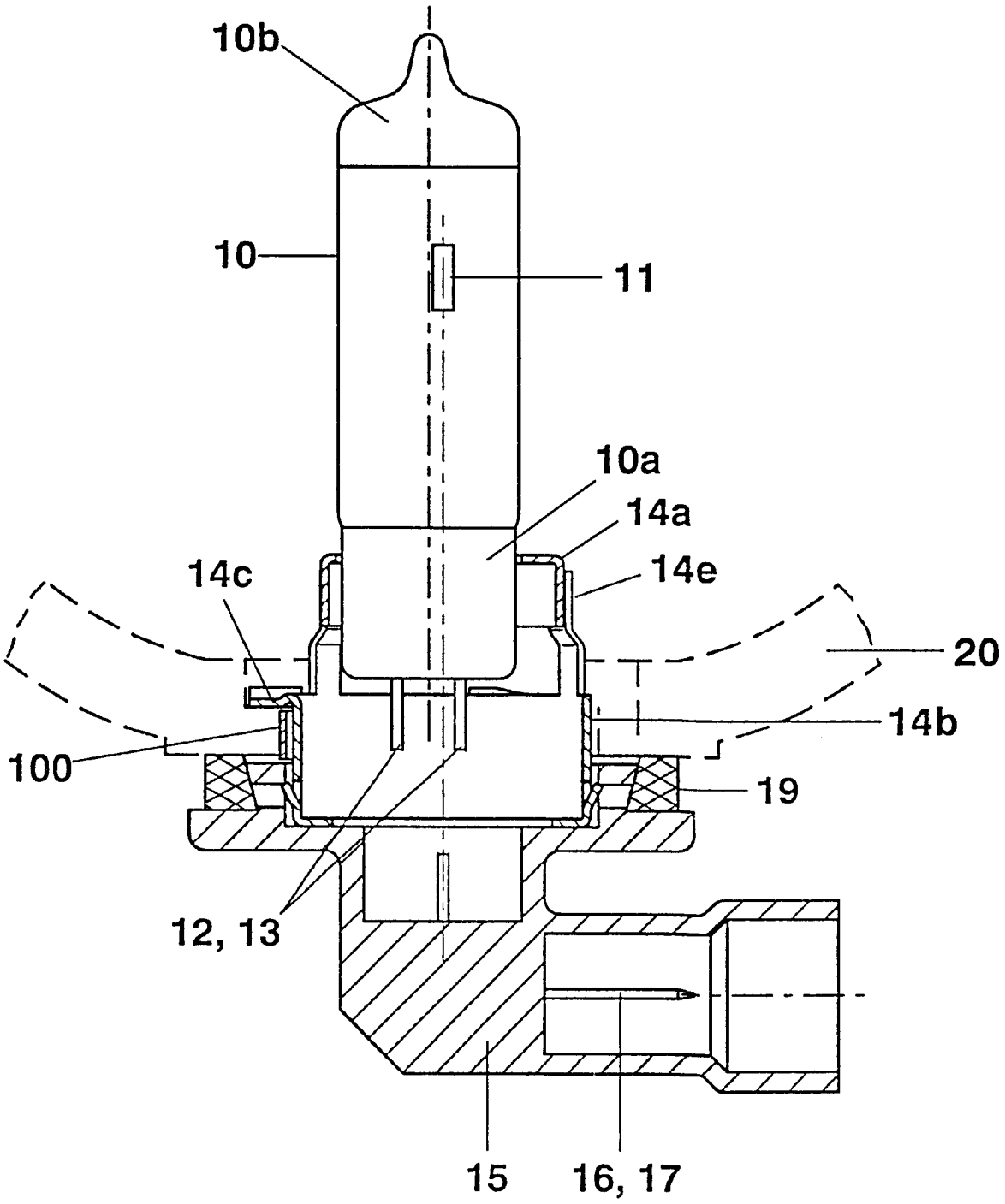
FIG. 1 shows a side view of the preferred embodiment in a diagrammatic, partially sectioned view with a reflector indicated by dashes.

It is the object of the invention to provide an electric lamp having an improved pressing-on spring and an improved fastening for the pressing-on spring. This object is achieved according to the invention by means of the characterizing features of Patent claim 1. Particularly advantageous designs of the invention are described in the subclaims. The electric lamp according to the invention has a lamp cap, a transparent lamp bulb and at least one luminous means surrounded by the lamp bulb. The lamp cap has a metal holder part for the lamp bulb, an annular metal carrier sleeve connected to the holder part, and a plastic cap part which is provided with the electric connections of the lamp and in which the carrier sleeve is anchored. In order to mount the lamp according to the invention in a headlight reflector, the lamp cap is equipped with a pressing-on spring which is constructed as a leaf spring and ensures that the lamp is held with a clamping fit in the reflector opening, constructed as lamp holder, of the headlight. The pressing-on spring bears against the inner wall of the annular carrier sleeve, and reaches through a cut-out in the carrier sleeve. According to the invention, the carrier sleeve has two inwardly angled lugs which are crossed in each case with one end of the leaf spring, and between which the leaf spring is arranged with a clamping fit. As a result, the pressing-on spring is fastened directly on the carrier sleeve in a reliable and simple way, that is to say without additional fastening means. The angled lugs are formed from the material of the carrier sleeve. The pressing-on spring constructed as a leaf spring is arranged with a clamping fit between the two angled lugs, which serve the leaf spring ends as a stop.

Each end of the leaf spring is advantageously equipped with at least two teeth between which the respective inwardly angled lug of the carrier sleeve is arranged. The above named teeth permit the respective leaf spring end to be crossed with the corresponding lug of the carrier sleeve. The angled lugs advantageously form an acute angle with the carrier sleeve, each leaf spring end being arranged in the region of the acute angle between the corresponding angled lug and the carrier sleeve wall. As a result, the lugs additionally act as a guidance aid for the leaf spring ends, so that the ends of the leaf spring are fixed in a clamped fashion between the lugs and the carrier sleeve wall because of the mechanical tension in the leaf spring.

The pressing-on spring, constructed as a leaf spring, of the lamp according to the invention advantageously has a V-shaped section which reaches through the cut-out in the carrier sleeve, and two U-shaped sections between which the V-shaped section is arranged, the U-shaped sections respectively connecting one V-limb of the V-shaped section to an end of the leaf spring. With the aid of the U-shaped sections, a mechanical tension is advantageously produced in the leaf spring, and the clamping fit of the leaf spring is produced between the angled lugs of the carrier sleeve. The V-shaped section, which reaches through the cut-out in the carrier sleeve, bears resiliently after mounting of the lamp in the reflector opening, constructed as lamp holder, in the headlight. The connecting region between the two limbs of the V-shaped section is advantageously rounded off, in order to enlarge the contact area between the pressing-on spring and lamp holder, and in order to facilitate the mounting of the lamp in the holder. The leaf spring advantageously bears against the inner wall of the carrier sleeve in the transition regions between the V-shaped section and the U-shaped sections and in the transition regions between the U-shaped sections and the respective leaf spring end. The stability of the fastening of the pressing-on spring is increased thereby.

The preferred exemplary embodiment of the invention is a single-filament halogen incandescent lamp which is provided for use in a motor vehicle headlight. This lamp has a vitreous, essentially cylindrical lamp bulb 10 having a pinch foot 10*a* sealed in a gas tight fashion. The dome 10*b* of the lamp bulb 10 is provided with a light-absorbing coating. Serving as light source is an incandescent filament 11 which is aligned parallel to the lamp bulb axis and is connected in an electrically conductive fashion to two supply leads 12, 13 which are guided out of the pinch foot 10*a* and consist of molybdenum wire. The pinch foot 10*a* of the lamp bulb 10 is fixed in a metal holder which consists of the cup-like holder part 14*a*, the intermediate ring 14*e* and the annular carrier sleeve 14*b*. In addition to the metal holder 14*a*, 14*b*, the lamp cap also has a plastic cap part 15 which is provided with the electric connections 16, 17 of the lamp and in which the annular metal carrier sleeve 14*b* is anchored. The carrier sleeve 14*b* has three reference noses 14*c*, situated in a plane, and a pressing-on spring 100 for mounting the lamp in the reflector 20 of a motor vehicle headlight. The sealing of the reflector 20 is performed by means of a silicone sealing ring 19 which bears against the outer wall 20*b* of the reflector 20 and against the plastic cap part 15. The design of the lamp in accordance with the preferred exemplary embodiment, and its use in a headlight are represented diagrammatically in FIG. 1.

Figure 2:
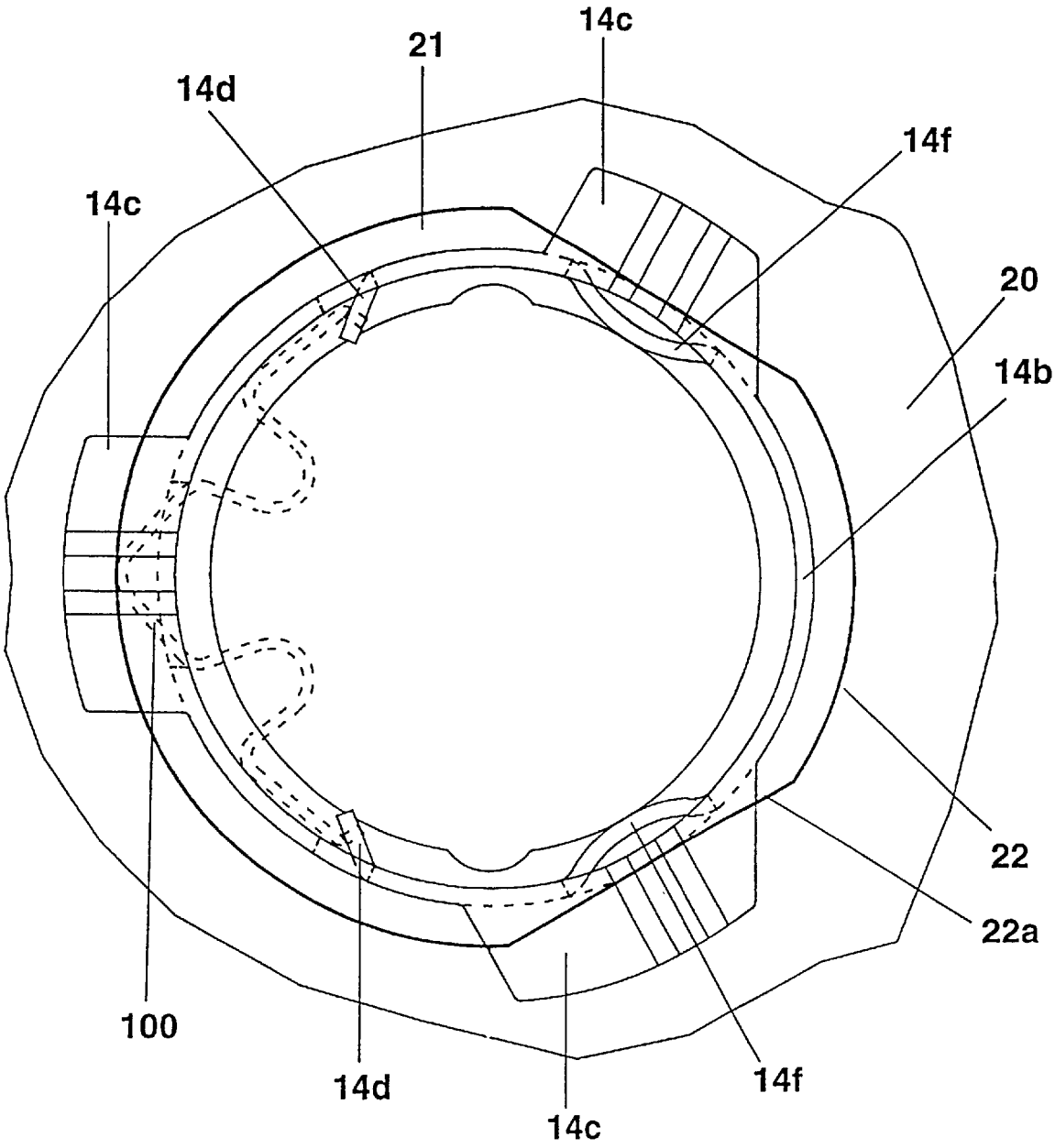
FIG. 2 shows a top view of the connection between the carrier sleeve of the lamp in accordance with FIG. 1 and the reflector of the headlamp
Figure 3:
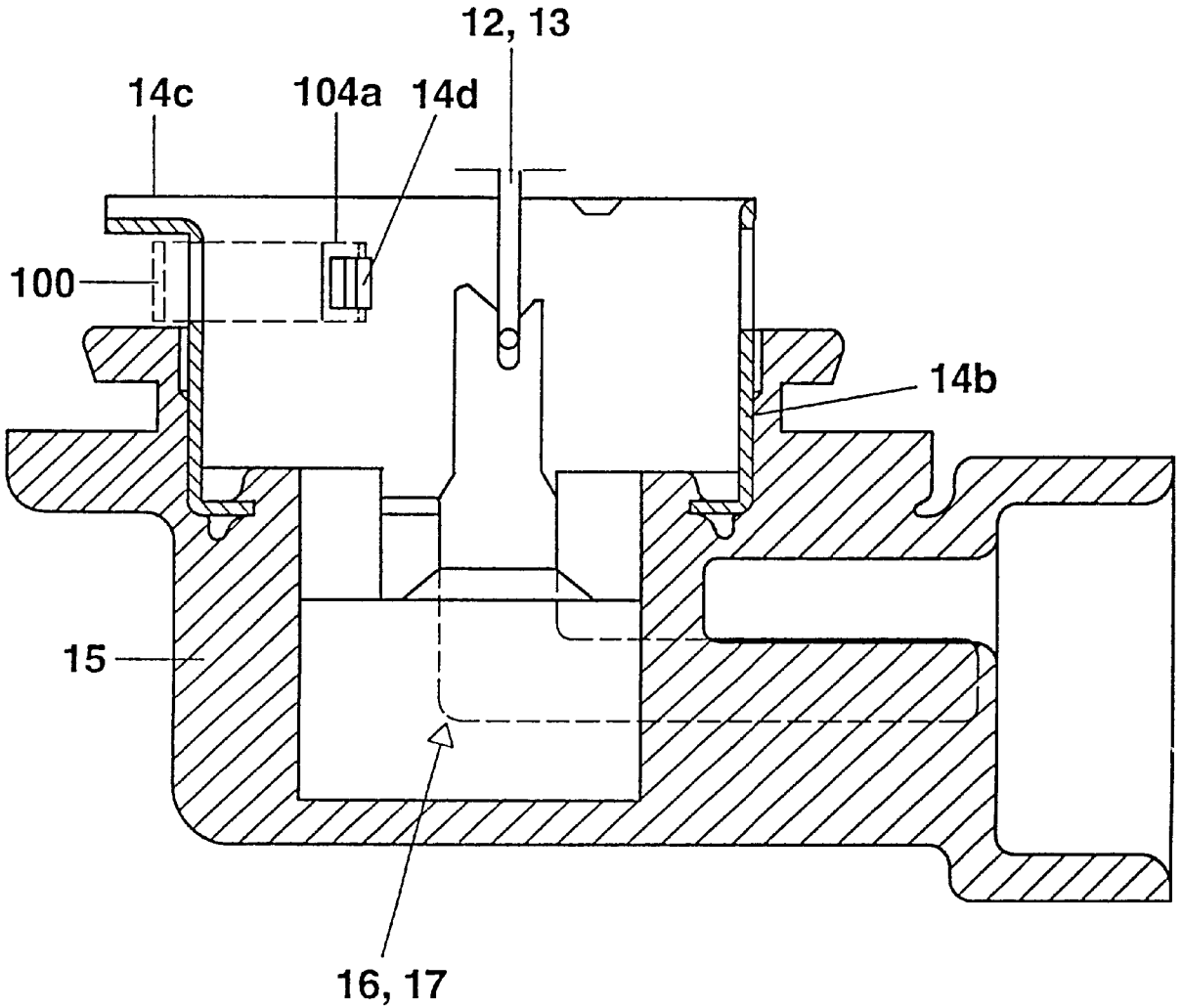
FIG. 3 shows a cross section through the plastic cap part and the carrier sleeve of the lamps from FIG. 1
Figure 4:
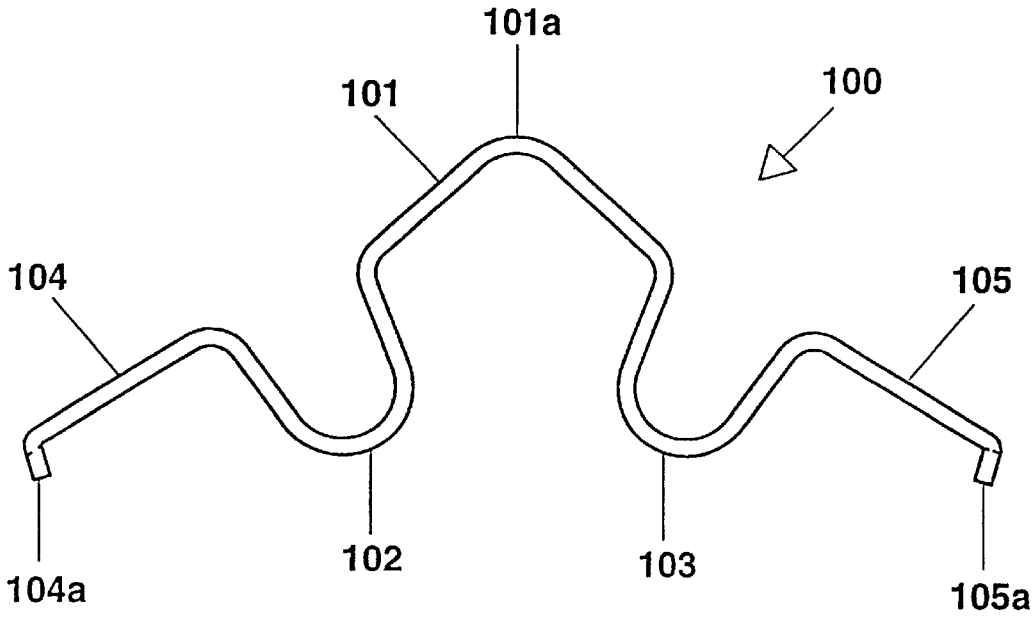
FIG. 4 shows a side view of the pressing-on spring of the lamp in FIG. 1.
Figure 5:
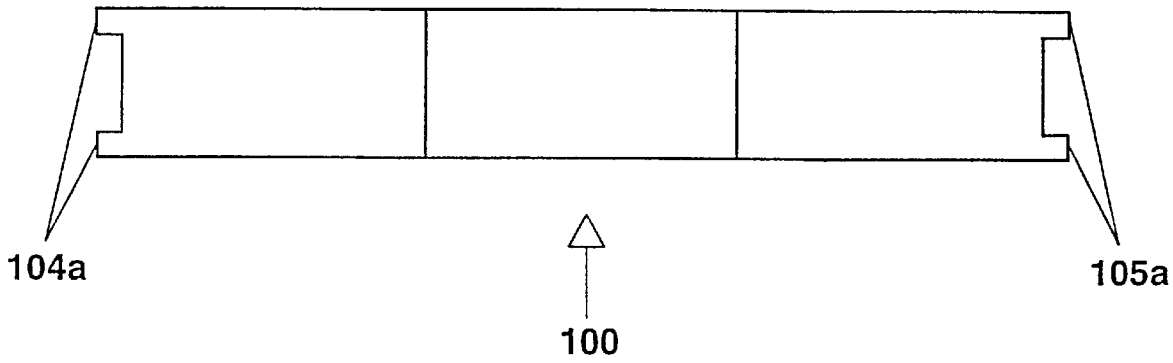
FIG. 5 shows a top view of the pressing-on spring of FIG. 4.

FIG. 2 shows details of the arrangement of the lamp in the reflector 20 of the motor vehicle headlight. The three reference noses 14*c* engage in the mounting opening 21, constructed as lamp holder, of the reflector 20, and bear against the inside 20*a* of the reflector 20. They 14*c* are distributed equidistantly over the circumference of the annular carrier sleeve 14*b*. The pressing-on spring 100 of the carrier sleeve 14*b* is arranged below a first reference nose 14*c*, and bears resiliently against the edge 22 of the lamp mounting opening 21. The purpose of fastening the pressing-on spring 100 on the carrier sleeve 14*b* is served by two lugs 14*d* which are integrally formed on the annular carrier sleeve 14*b*, are angled inwards and between which the pressing-on spring 100 constructed as leaf spring is arranged with a clamping fit (FIG. 3). The lugs 14*b* form an acute angle with the carrier sleeve wall. The leaf spring 100 consists of a spring steel. Its shape is shown in FIGS. 4 and 5.

The leaf spring 100 has a V-shaped section 101 which is arranged between two U-shaped sections 102, 103. The U-shaped sections 102, 103 in each case connect a limb of the V-shaped section 101 to a leaf spring end 104, 105. Each leaf spring end 104, 105 is equipped with two teeth 104*a*, 105*a*, between which the corresponding lug 14*d*, angled from the carrier sleeve 14*b*, is arranged in each case (FIG. 3). The teeth 104*a*, 105*a* enclose an angle of 105 degrees with the leaf spring ends 104, 105. The V-shaped section 101 reaches through a cut-out in the carrier sleeve 14*b*, and after the lamp mounting the rounded-off connecting region 101*a* arranged between the two limbs of the V-shaped section 101 bears resiliently against the edge 22 of the reflector opening 21 constructed as lamp holder. The leaf spring 100 bears against the inner wall of the carrier sleeve 14*b* in the transition regions between the V-shaped section 101 and the U-shaped sections 102, 103, as well as in the transition regions between the U-shaped sections 102 and 103 and the respective leaf spring end 104, 105.

The outside of the carrier sleeve 14*b* has a depression 14*f* in each case below the other two reference noses 14*c*. The edge 22 of the lamp mounting opening 21 of the reflector 20 in each case has a prismatic bearing surface 22*a* in the region of the two abovenamed other reference noses 14*c*. The outside of the carrier sleeve 14*b* of the lamp cap bears with a clamping fit against these two prismatic bearing surfaces 22*a*. The clamping effect is produced by means of the pressing-on spring 100. The depressions 14*f* ensure that the outer edge 22*a*2, possibly affected by a burr, of the edge 22 of the mounting opening 21 is arranged not to contact the lamp cap and, in particular, not to contact the carrier sleeve 14*b*.

What is claimed is:

1. Electric lamp having a lamp cap, a transparent lamp bulb (10), and having at least one luminous means (11) surrounded by the lamp bulb (10), in which the lamp cap has a metal holder part (14*a*) in which the lamp bulb (10) is fixed, the lamp cap has an annular metal carrier sleeve (14*b*) connected to the holder part (14*a*), and a plastic cap part (15) which is provided with the electric connections (16, 17) of the lamp and in which the carrier sleeve (14*b*) is anchored, and the lamp cap has a pressing-on spring (100) constructed as a cambered leaf spring which bears against the inner wall of the carrier sleeve (14*b*) and reaches through a cut-out in the annular carrier sleeve (14*b*), characterized in that the annular carrier sleeve (14*b*) has two inwardly angled lugs (14*d*) which are crossed in each case with one end (104, 105) of the leaf spring (100), and the leaf spring (100) is arranged with a clamping fit between the inwardly angled lugs (14*d*).

2. Electric lamp according to claim 1, characterized in that each leaf spring end (104, 105) is equipped with at least two teeth (104*a*, 105*a*) between which the respective, inwardly angled lug (14*d*) of the carrier sleeve (14*b*) is arranged.

3. Electric lamp according to claim 1, characterized in that the angled lugs (14*d*) respectively form an acute angle with the carrier sleeve (14*b*), each leaf spring end (104, 105) being arranged in the region of the acute angle between the corresponding angled lug (14*d*) and the carrier sleeve wall.

4. Electric lamp according to claim 1, characterized in that the leaf spring (100)

has a V-shaped section (101) which reaches through the cut-out in the carrier sleeve (14*b*)

has two U-shaped sections (102, 103) between which the V-shaped section (101) is arranged, the U-shaped sections (102, 103) in each case forming a limb of the V-shaped section (101) with one end (104, 105) of the leaf spring (100).

5. Electric lamp according to claim 4, characterized in that the leaf spring (100) bears against the inner wall of the carrier sleeve (14*b*) in the transition regions between the V-shaped section (101) and the U-shaped sections (102, 103).

6. Electric lamp according to claim 4, characterized in that the leaf spring (100) bears against the inner wall of the carrier sleeve (14*b*) in the transition regions between the U-shaped sections (102, 103) and the respective leaf spring end (104, 105).

7. Electric lamp according to claim 4, characterized in that the connecting region (101*a*) between the two V-limbs (101) is rounded off.

* * * * *